US011365108B2

(12) United States Patent
Riis et al.

(10) Patent No.: US 11,365,108 B2
(45) Date of Patent: Jun. 21, 2022

(54) DISPENSE HEAD AND BEVERAGE DISPENSING SYSTEM

(71) Applicant: MICRO MATIC A/S, Odense SV (DK)

(72) Inventors: Ken Riis, Odense SV (DK); Ulrik Lismann Hansen, Odense SV (DK)

(73) Assignee: MICRO MATIC A/S, Odense SV (DK)

( * ) Notice: Subject to any disclaimer, the term of this patent is extended or adjusted under 35 U.S.C. 154(b) by 0 days.

(21) Appl. No.: 17/292,780

(22) PCT Filed: Nov. 11, 2019

(86) PCT No.: PCT/EP2019/080813

§ 371 (c)(1),
(2) Date: May 11, 2021

(87) PCT Pub. No.: WO2020/099294

PCT Pub. Date: May 22, 2020

(65) Prior Publication Data

US 2021/0395068 A1 Dec. 23, 2021

(30) Foreign Application Priority Data

Nov. 12, 2018 (EP) ..... 18205627

(51) Int. Cl.
*B67D 1/08* (2006.01)

(52) U.S. Cl.
CPC ..... *B67D 1/0848* (2013.01); *B67D 1/0835* (2013.01); *B67D 1/0849* (2013.01)

(58) Field of Classification Search
CPC .. B67D 1/0848; B67D 1/0835; B67D 1/0849; B67D 1/0832
See application file for complete search history.

(56) References Cited

U.S. PATENT DOCUMENTS 3,194,451 A 7/1965 Fletcher
5,205,440 A * 4/1993 Matsushita ..... B67D 1/0835 222/83

(Continued)

FOREIGN PATENT DOCUMENTS

FR 2 478 752 9/1981
FR 2 544 026 10/1984

OTHER PUBLICATIONS

International Search Report for PCT/EP2019/080813 dated Mar. 24, 2020, 3 pages.

(Continued)

*Primary Examiner* — Donnell A Long
(74) *Attorney, Agent, or Firm* — Nixon & Vanderhye P.C.

(57) ABSTRACT

The present invention relates to a dispense head to be mounted on a beverage container having an extractor tube with a valve, the beverage container or the extractor tube having a radially extending flange, enabling a beverage present in the beverage container to be dispensed via a dispensing line, the dispense head having an axial extension and comprising an outer shell comprising a first aperture configured to receive at least the dispensing line and/or a gas inlet, the outer shell being movable along the axial extension between a first position and a second position, a stationary inner part arranged inside the outer shell, a first face of the stationary inner part is configured to abut the flange and be axially stationary in relation to the flange, the stationary inner part having a first end and a second end facing the beverage container, the stationary inner part having a wall part at the second end, a valve activation part at least partly extending inside the stationary inner part and movable in the axial extension in relation the stationary inner part for activation of the valve, and a handle pivoting around a pivot point in the first end of the stationary inner part for moving between a deactivated position and an activated position for moving the valve activation part in order to activate the valve, wherein the dispense head further comprises a locking unit arranged at the second end of the stationary inner part, the locking unit being arranged at a distance from the first face and configured to be radially displaced during the movement of the outer shell from the first position to the second position thereby enabling locking of the flange along the axial extension, and a fixation unit configured to fixate (Continued)

Figure 1:
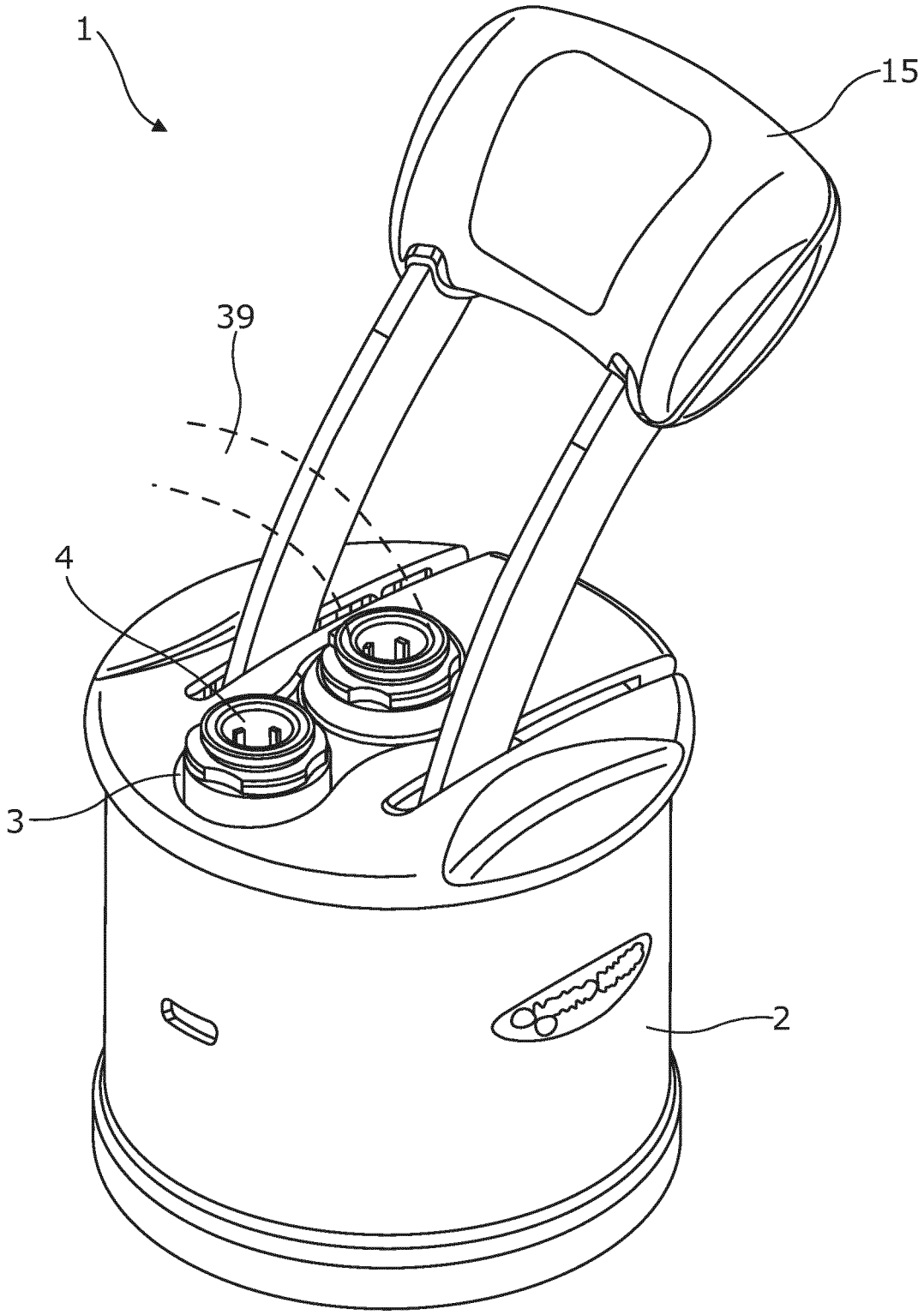

the outer shell in relation to the stationary inner part at least in the second position of the outer shell.

16 Claims, 11 Drawing Sheets

(56) References Cited

U.S. PATENT DOCUMENTS

| | | | | |
|---|---|---|---|---|
| 5,901,747 | A * | 5/1999 | Rokkjaer | B67D 1/0839 137/614.2 |
| 2003/0106610 | A1* | 6/2003 | Roos | B67D 3/043 141/346 |
| 2010/0308084 | A1* | 12/2010 | Riis | B67D 1/07 222/400.7 |
| 2010/0308544 | A1* | 12/2010 | Riis | B67D 1/0847 277/602 |
| 2014/0124543 | A1* | 5/2014 | Dahl | B67D 1/0848 222/400.7 |
| 2016/0200561 | A1* | 7/2016 | Dalton | B67D 1/14 137/505 |
| 2019/0352165 | A1* | 11/2019 | Corstanje | B67D 1/0832 |
| 2020/0094441 | A1* | 3/2020 | Covi | B65D 11/06 |
| 2021/0253413 | A1* | 8/2021 | Szeteli | B67D 1/0835 |

OTHER PUBLICATIONS

Written Opinion of the ISA for PCT/EP2019/080813 dated Mar. 24, 2020, 6 pages.
Extended European Search Report for EP18205627.5 dated Jun. 24, 2019, 5 pages.

* cited by examiner

DISPENSE HEAD AND BEVERAGE DISPENSING SYSTEM

This application is the U.S. national phase of International Application No. PCT/EP2019/080813 filed Nov. 11, 2019 which designated the U.S. and claims priority to EP Patent Application No. 18205627.5 filed Nov. 12, 2018, the entire contents of each of which are hereby incorporated by reference.

The present invention relates to a dispense head to be mounted on a beverage container, enabling a beverage present in the beverage container to be dispensed via a dispensing line.

Consumers are more aware of the dispensing of beverages, such as beer, due to the fact that beer consumers have become increasingly conscious of the quality of the beer they drink, and they tend to base their beer label preferences on the final impression of the beer, i.e. the dispensed beer.

The impression of a newly dispensed beer is influenced by the taste and how it appears to the consumer. Also, the taste of the beer may change as the temperature of the beer varies. In view of this, it is of high importance that the dispensing devices serve the purpose of dispensing beer within the right temperature range and with the right amount of $CO_2$ in the beer.

The amount of $CO_2$ in a newly dispensed beer is influenced by the amount of $CO_2$ applied to the beer at the time of manufacture and also by the conditions under which the beer has been stored. The amount of $CO_2$ applied to the beer will migrate out of the beer if the beer is not kept under pressure in the beer keg. Therefore, it is very important that the pressure of the $CO_2$, besides being adequate for dispensing the beer, is also adequate for keeping the pressure balance in the beer keg, hence keeping the beer fizzy and foamy after dispensing.

Furthermore, beer dispensing devices have become accessible to more consumers, and beer dispensing devices are increasingly being installed in private homes, companies, sports facilities etc., where no trained personnel operate the dispensing devices. Thus, the safety of the user of the dispensing device and the hygiene of the device have likewise become very important.

When dispensing beverages, such as beer, in a bar facility, it may sometimes be difficult for the personnel to clean the device properly, or it might just be de-emphasised in the daily routines.

Furthermore, the traditional beverage dispensing systems utilise dispense heads being coupled to the beverage containers for activating the valve in the beverage containers. There are many different beverage container systems which calls for many different types of dispense heads, each being configured to interact with a specific type of beverage container. Hence, there is a need for providing a more universal dispense head which may be coupled to a number of different beverage containers.

It is an object of the present invention to wholly or partly overcome the above disadvantages and drawbacks of the prior art. More specifically, it is an object to provide an improved dispense head which may fit several types of extractor tube systems, and which at the same time is easy to use.

The above objects, together with numerous other objects, advantages and features, which will become evident from the below description, are accomplished by a solution in accordance with the present invention by a dispense head to be mounted on a beverage container having an extractor tube with a valve, the beverage container or the extractor tube having a radially extending flange, enabling a beverage present in the beverage container to be dispensed via a dispensing line connected with the dispense head, the dispense head having an axial extension and comprising:

- an outer shell comprising a first aperture configured to receive at least the dispensing line and/or a gas inlet, the outer shell being movable along the axial extension between a first position and a second position,
- a stationary inner part arranged inside the outer shell, a first face of the stationary inner part being configured to abut the flange and be axially stationary in relation to the flange, the stationary inner part having a first end and a second end facing the beverage container, the stationary inner part having a wall part at the second end,
- a valve activation part at least partly extending inside the stationary inner part and movable in the axial extension in relation the stationary inner part for activation of the valve, and
- a handle pivoting around a pivot point in the first end of the stationary inner part for moving between a deactivated position and an activated position for moving the valve activation part in order to activate the valve of the extractor tube, wherein the dispense head further comprises:
- a locking unit arranged at the second end of the stationary inner part, the locking unit being arranged at a distance d from the first face and configured to be radially displaced during the movement of the outer shell from the first position to the second position thereby enabling locking of the flange along the axial extension, and
- a fixation unit configured to fixate the outer shell in relation to the stationary inner part at least in the second position of the outer shell.

Moreover, the fixation unit may comprise a groove and a pin engaging the groove, the groove being arranged in the stationary inner part or the outer shell and the pin being connected to the other of the stationary inner part and the outer shell.

Additionally, the groove may have a first top point and a second top point being axially displaced along the axial extension so that the first top point is arranged closer to the handle than the second top point.

Furthermore, the pin may be in the first top point when the outer shell is in the first position, and the pin may be in the second top point when the outer shell is in the second position.

Also, one or more springs may be arranged between a top part of the outer shell and the stationary inner part so that the one or more springs is/are being compressed when moving the outer shell from the first position to the second position.

In addition, the outer shell may comprise a lower part, the top part and the lower part being connected by a fastening element so that the top part and the lower part move together when moving the outer shell between the first and the second position.

Further, the dispense head may comprise several fixation units.

Moreover, the groove may be an endless groove.

Furthermore, the groove may be a J-slot, a V-slot, etc.

Additionally, the wall part of the stationary inner part may have a through-bore in which the locking unit is displaced along a radial extension perpendicular to the axial extension, the locking unit having a thickness in the radial extension being larger than a thickness of the wall part.

Also, the wall part of the stationary inner part may define a circular bore having a circumference and an inner diameter.

Further, the dispense head may comprise several locking units distributed along the circumference.

In addition, the dispense head may comprise 3-6 locking units evenly distributed along the circumference.

Moreover, the outer shell may have an opening which in the first position is arranged opposite a first indicator on the stationary inner part and in the second position is arranged opposite a second indicator for indicating the position of the outer shell.

Additionally, the outer shell may have a first shell part having a first distance to the wall part when being arranged opposite the locking unit in the first position, and a second shell part having a second distance to the wall part when being arranged opposite the locking unit in the second position, the second distance being smaller than the first distance.

Furthermore, the valve activation part may have an axially extending through-bore provided by a first wall for guiding beverage from the beverage container to the dispensing line, and a gas channel having an annular gas channel part circumferenting the through-bore and being provided by a channel wall.

Also, the valve activation part may further comprise an annular sealing element, the annular sealing element having a first element end part, an intermediate part and a second element end part, the first element end part being connected to the channel wall, the intermediate part abutting an outer face of the first wall, and the second element end part extending towards the beverage container, the first element end part has a wall thickness smaller than that of the second element end part so as to be able to bulge when compressed along the axial extension.

In addition, the first element end part may have an inner diameter being larger than that of the intermediate part.

Further, the first element end part may be connected to the channel wall by means of a T-shaped part.

Moreover, the outer shell may comprise a top part and a bottom part.

Additionally, the locking unit may comprise at least one projection configured to engage the flange.

Furthermore, the dispense head may comprise a plurality of first fingers arranged around a circumference of the stationary inner part with a mutual distance between them, each finger having a first free end part, the first free end part comprising the projection.

Also, one or more projection(s) may project radially from the inner part, the one or more projection(s) being configured to engage one or more receiving guide(s) arranged in the outer shell.

In addition, the receiving guides may be grooves or apertures having an extension in the axial extension so that the projection(s) is/are movable in the axial extension in the receiving guides.

Furthermore, the outer shell may be made of a polymeric material or metal. The polymeric material may for instance be polyoxymethylene (POM) or similar materials. When making the outer shell in a polymeric material, it may be injection moulded. The metal may for instance be stainless steel.

The stationary inner part may also be made of a polymeric material. The polymeric material may for instance be polyoxymethylene (POM) or similar materials. When making the stationary inner part in a polymeric material, it may be injection moulded.

The valve actuation part may also be made of a polymeric material. The polymeric material may for instance be polyoxymethylene (POM) or similar materials. When making the valve actuation part in a polymeric material, it may be injection moulded.

Moreover, a pressure relief valve may be arranged in fluid connection with the gas inlet.

The stationary inner part may have a support for the spring.

In addition, a one-way valve may be arranged in connection with the gas inlet.

The invention also relates to a beverage dispensing system comprising a beverage container having an extractor tube with a valve, the beverage container or the extractor tube having a radially extending flange, a dispense head as described above is coupled to the beverage container, a dispensing line, and a gas supply in fluid communication with a gas inlet of the dispense head.

Furthermore, the invention relates to a dispense head activation method, comprising:

providing a dispense head as described above, positioning the dispense head opposite the valve of the extractor tube of the beverage container so that the locking unit is arranged below the flange, moving the outer shell from the first position to the second position so that the locking unit is locking the flange while the fixation unit fixates the outer shell and the stationary inner part to each other, and activating the handle for moving it from a deactivated position to an activated position whereby the valve activation part is moved axially in order to activate the valve and open for the dispensing of beverage out of the beverage container.

The step of moving the outer shell from the first position to the second position is performed by pressing the outer shell in a downward direction.

Finally, the invention relates to a dispense head deactivation method, comprising activating the handle by moving it from the activated position to the deactivated position whereby the valve activation part is moved axially away from the valve in order to close the valve and close for the dispensing of beverage out of the beverage container, deactivating the fixation unit for bringing the outer shell from the second position to the first position, and removing the dispense head from the beverage container.

The step of deactivating the fixation unit is performed by pressing the outer shell in a downward direction.

Figure 2:
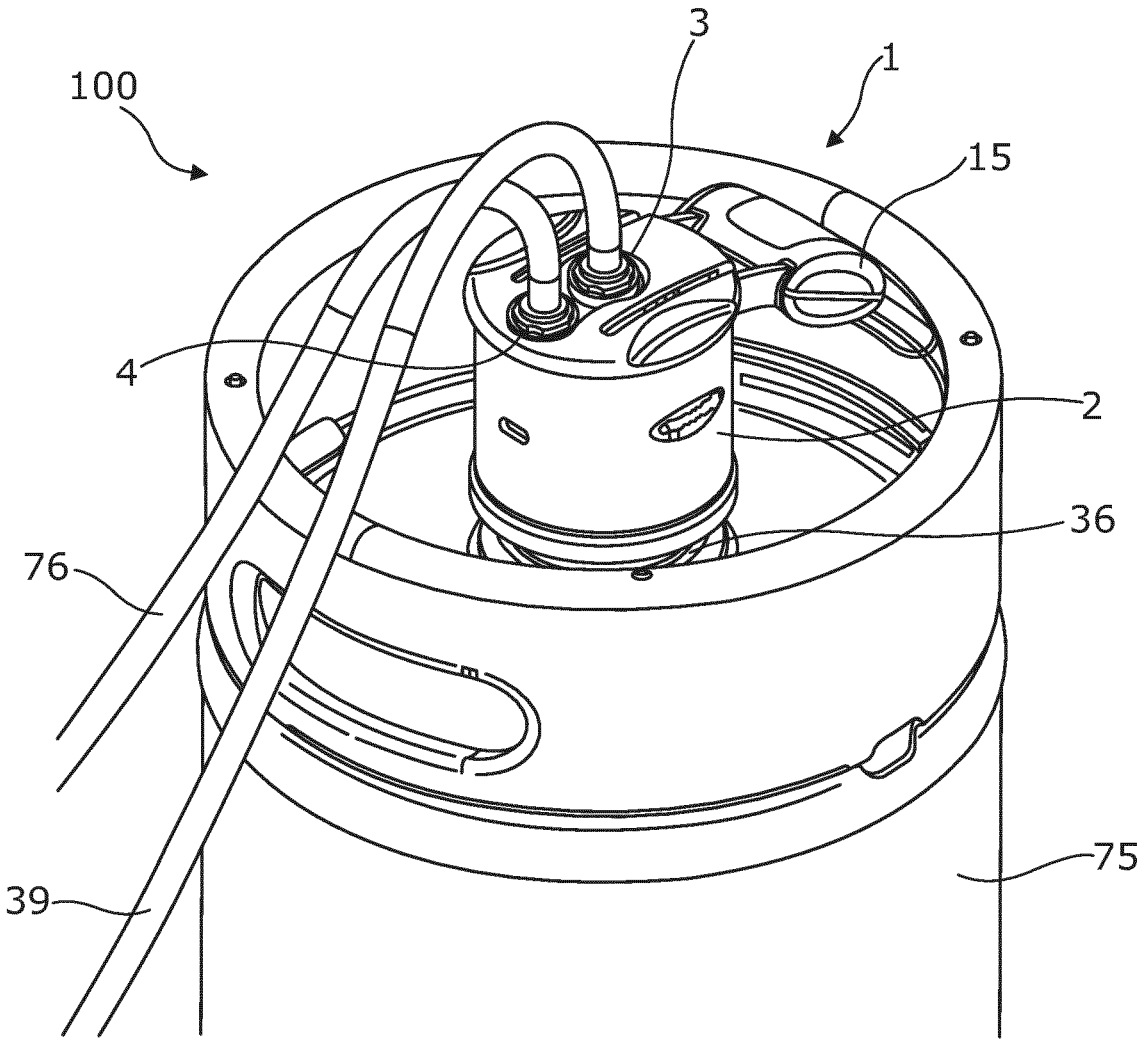
Figure 3:
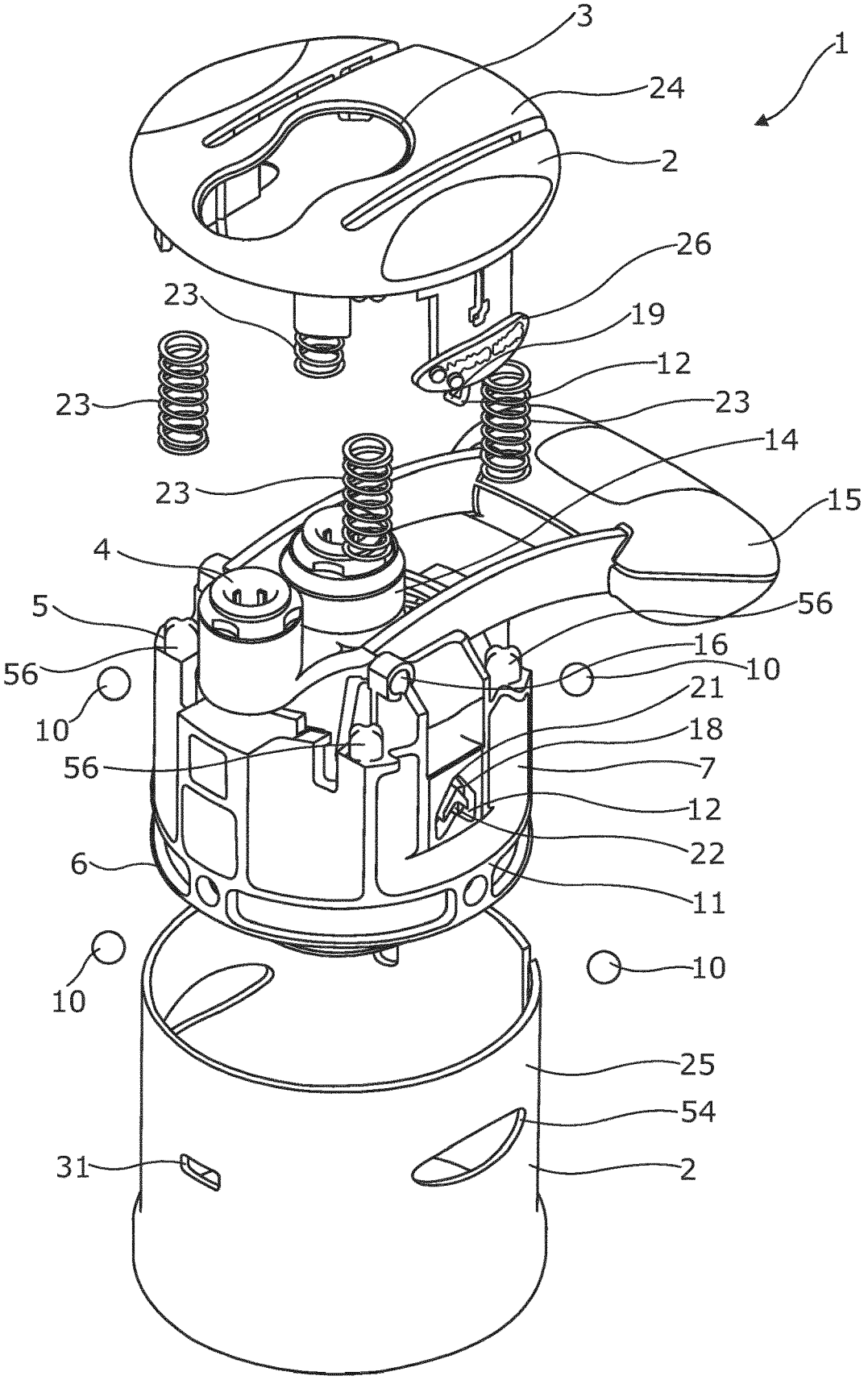
Figure 4:
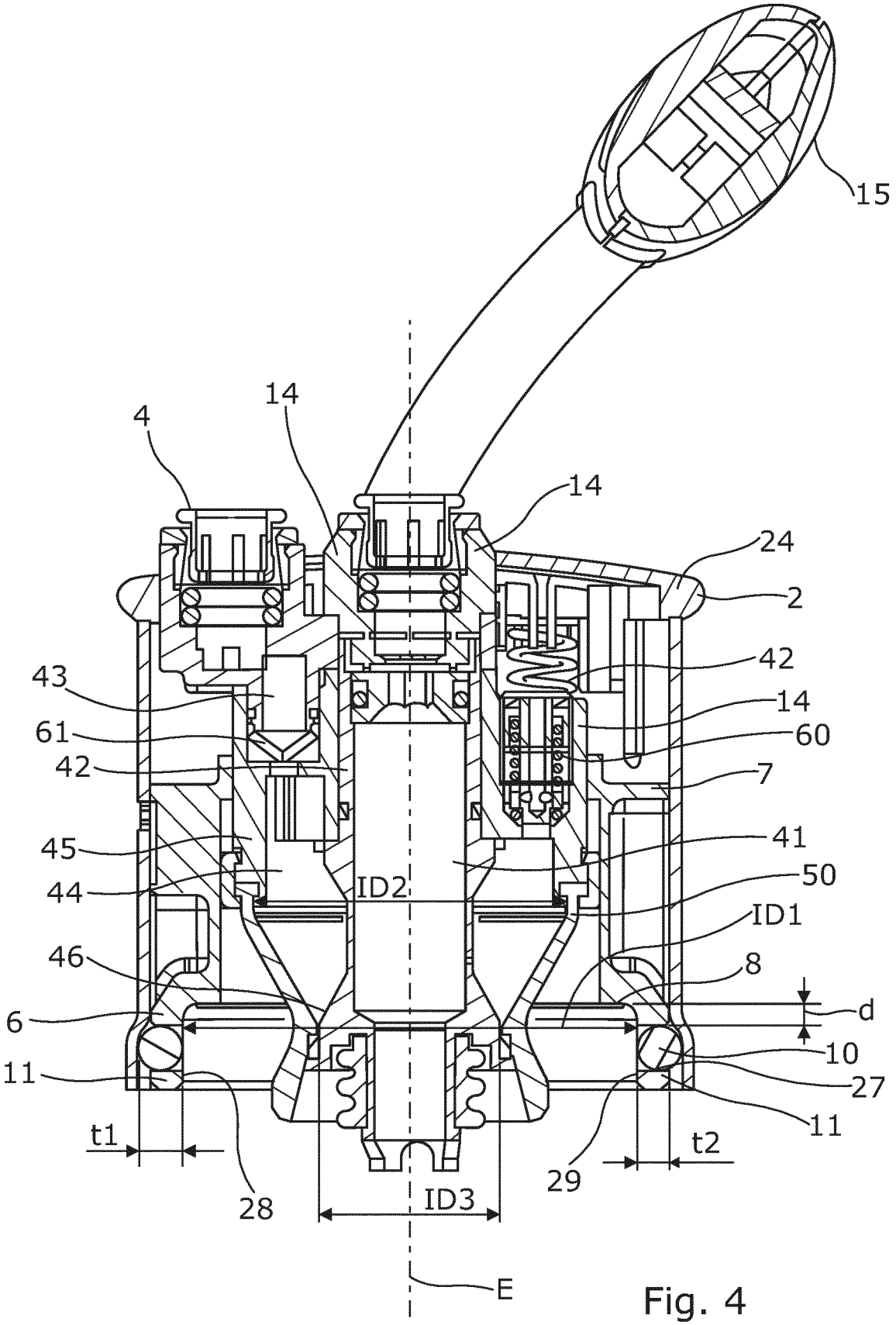
Figure 4A:
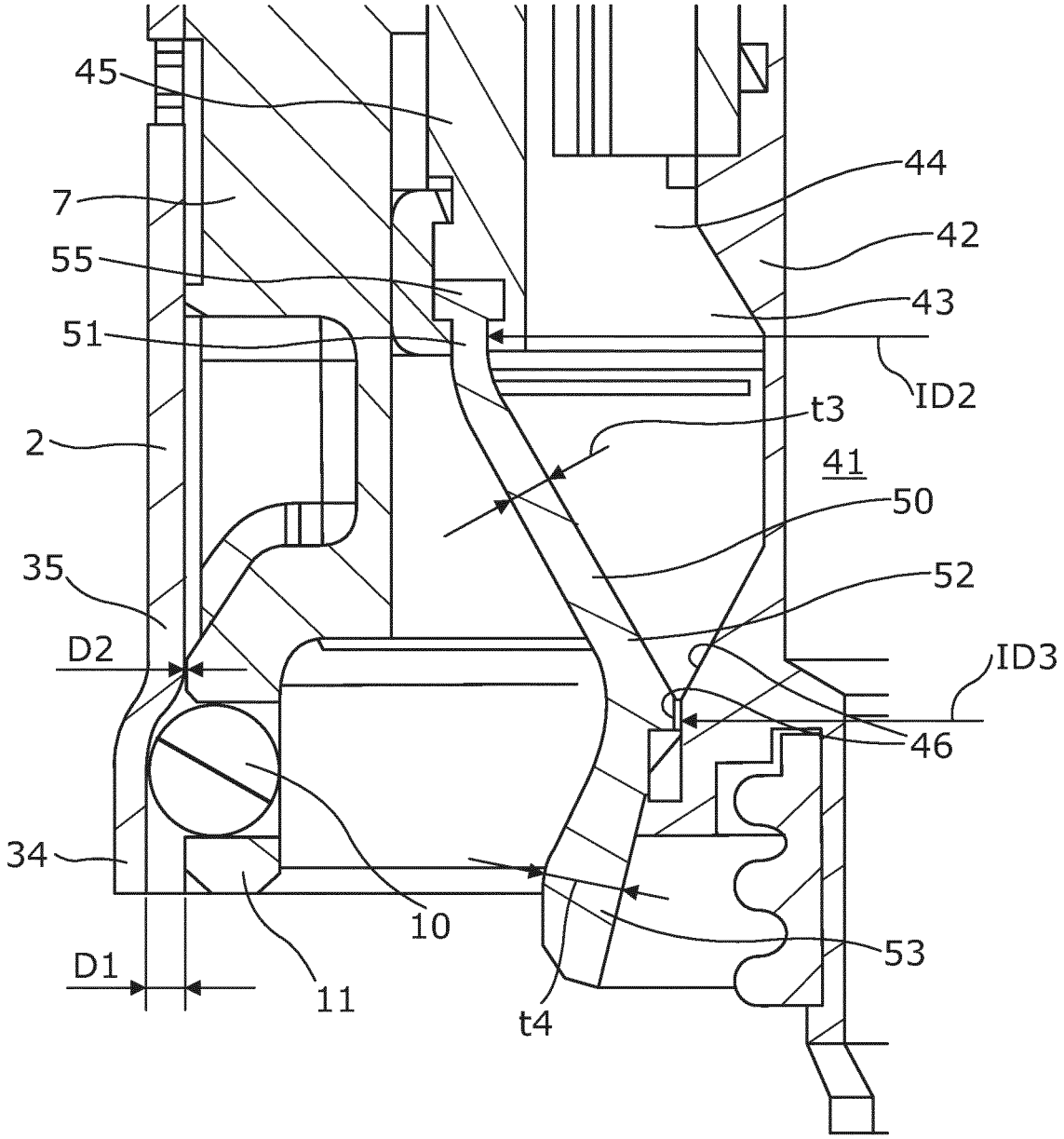
Figure 5A:
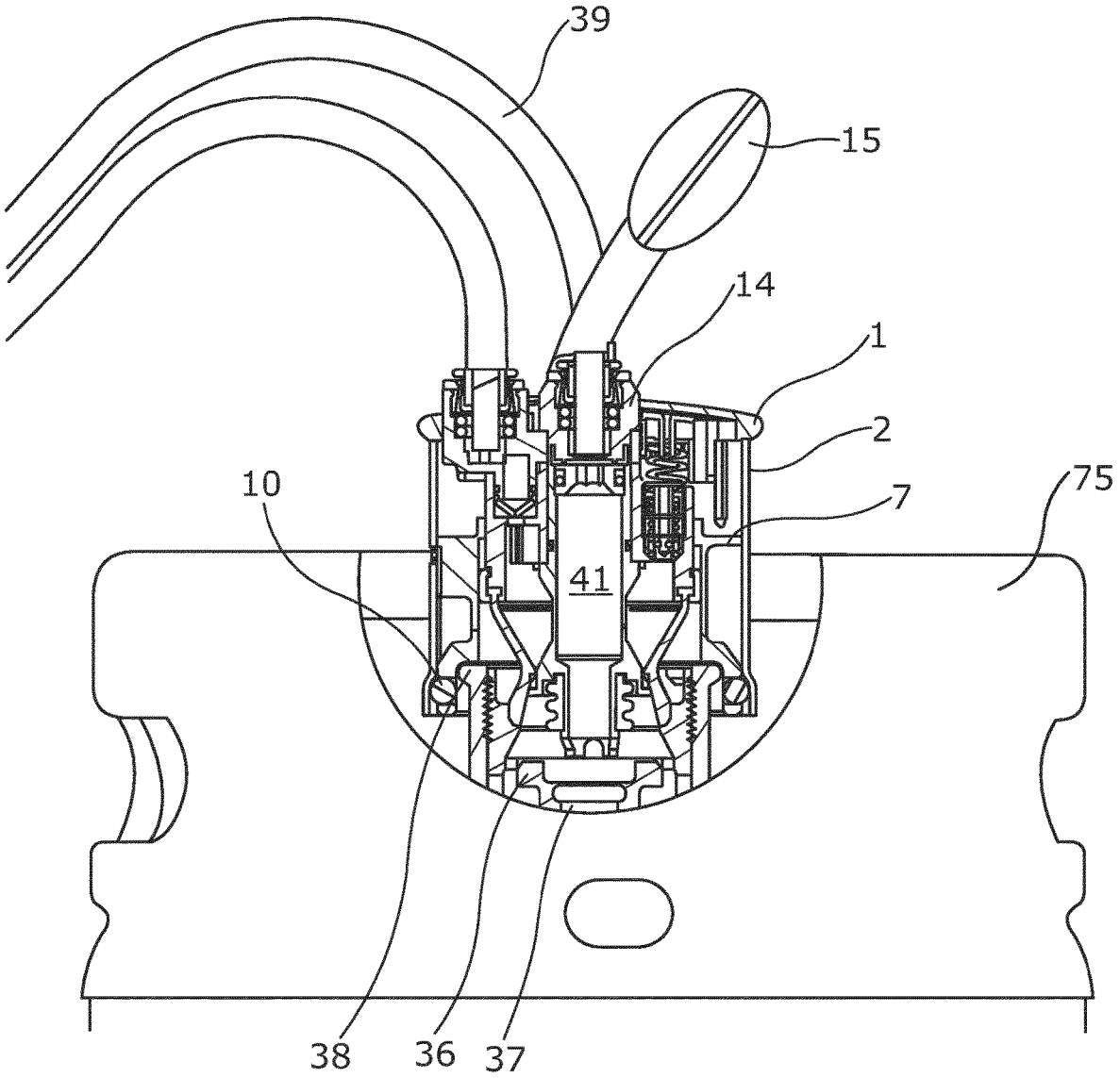
Figure 5B:
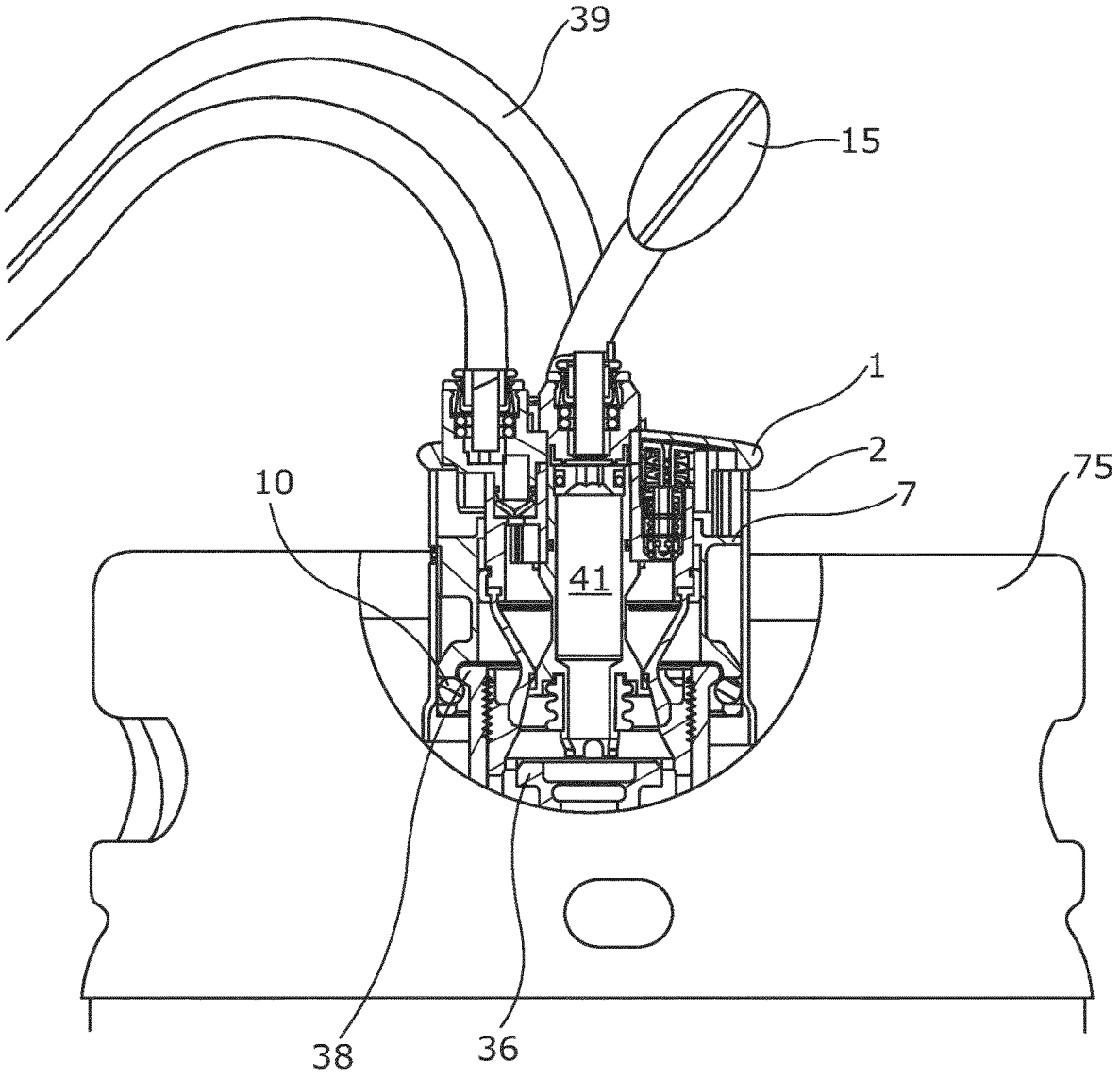
Figure 5C:
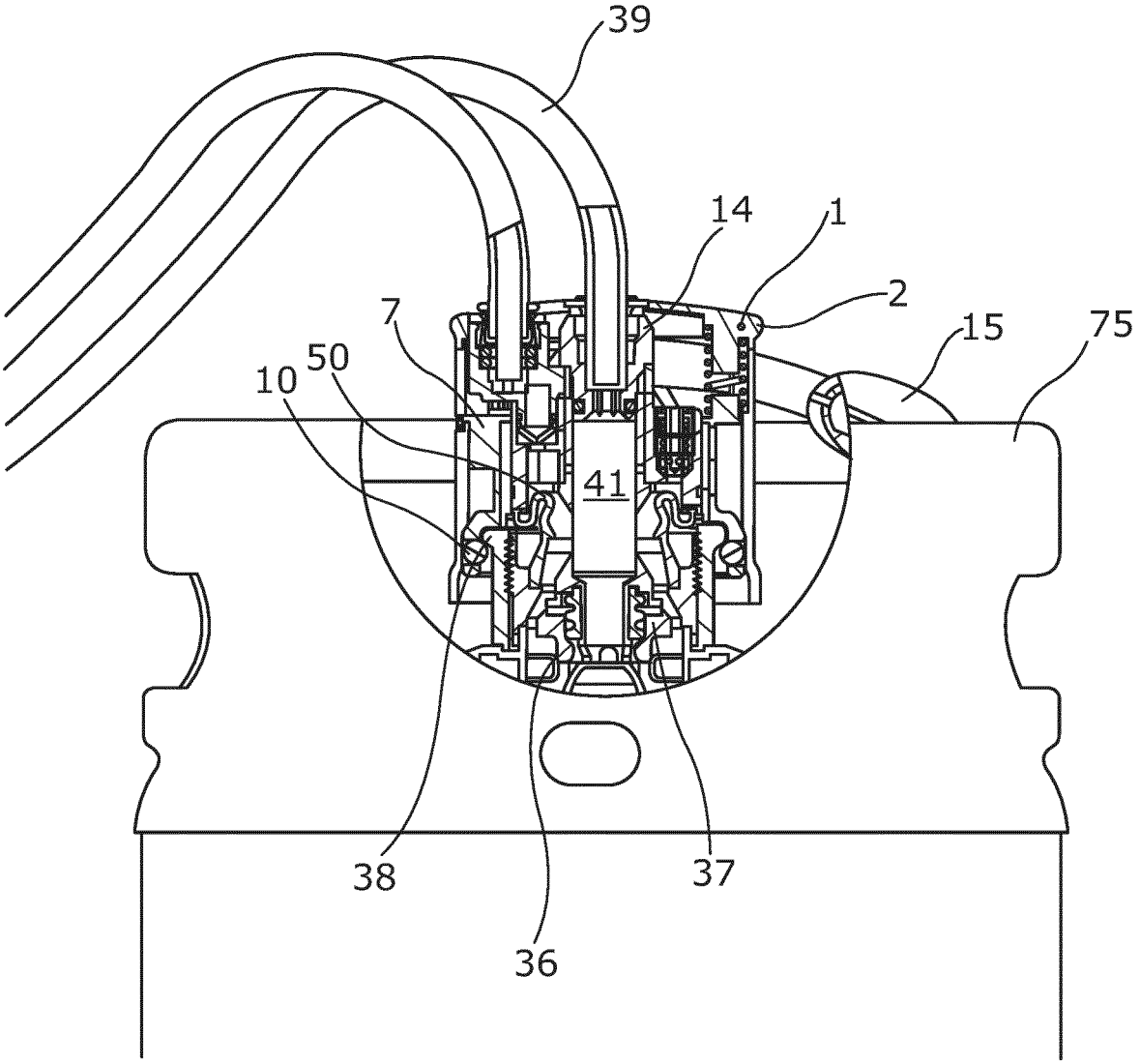
Figure 6:
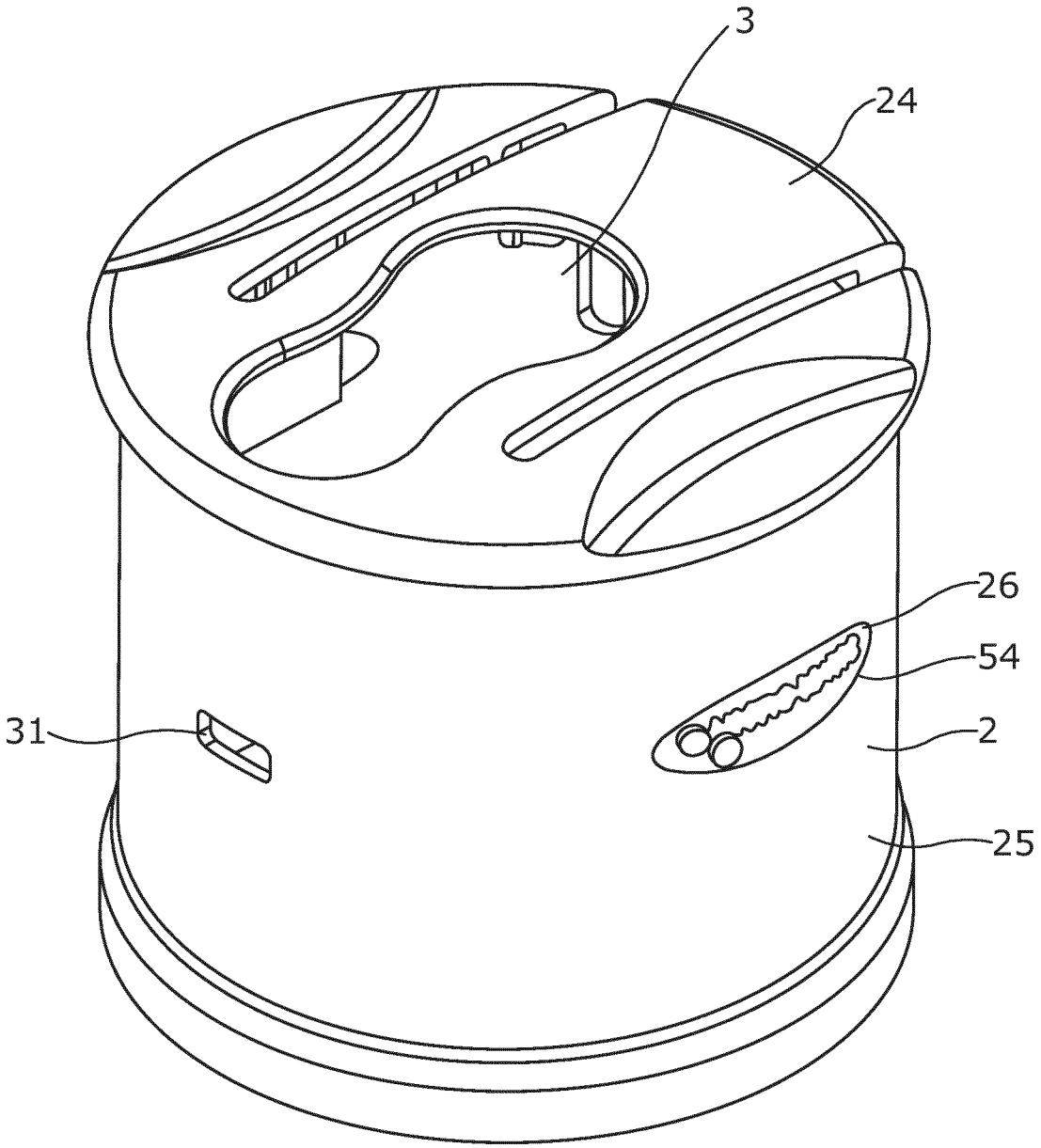
Figure 7:
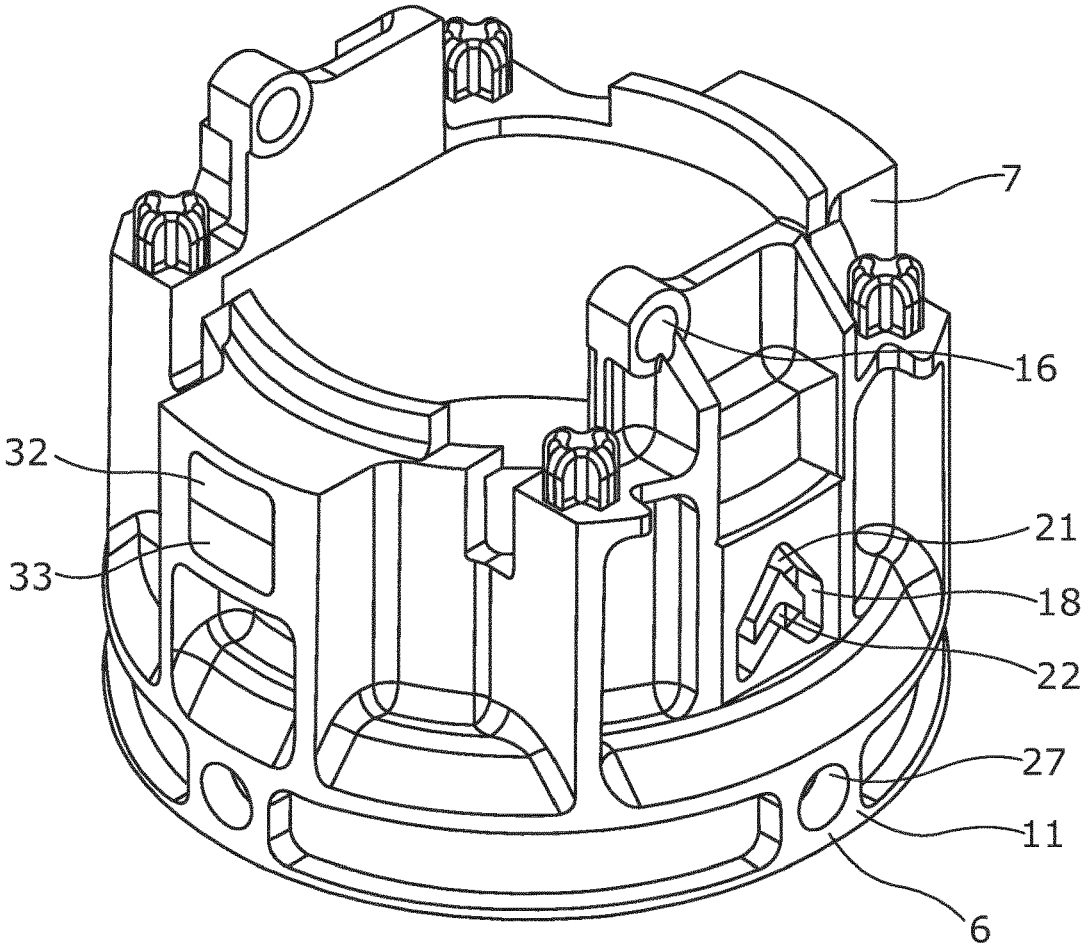
Figure 8:
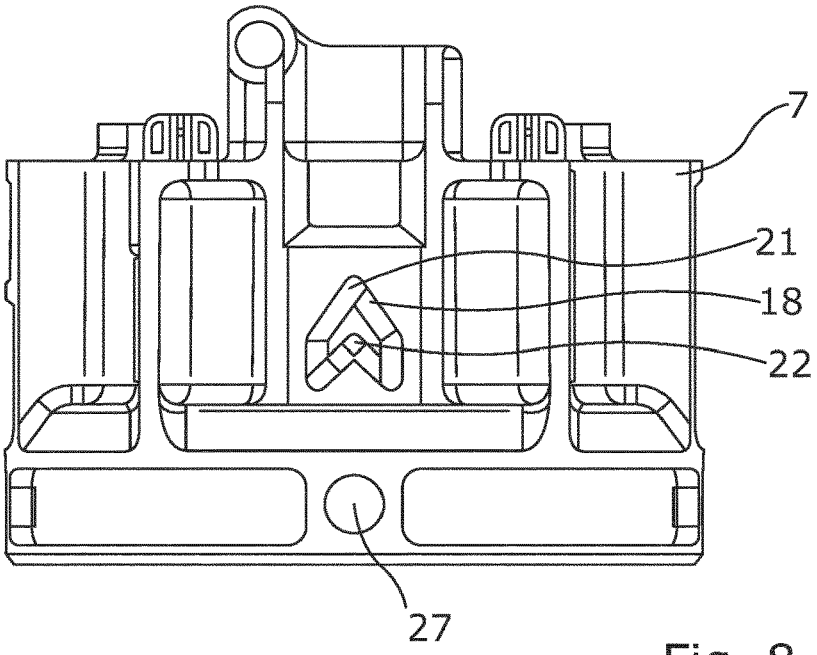
Figure 9:
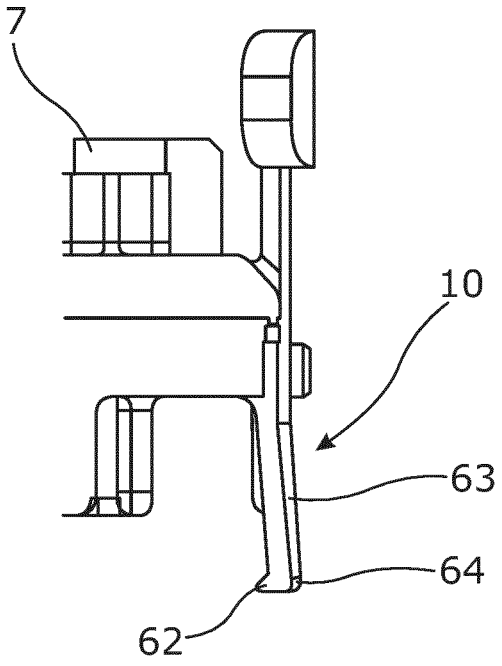

The invention and its many advantages will be described in more detail below with reference to the accompanying schematic drawings, which for the purpose of illustration show some non-limiting embodiments and in which:

FIG. 1 shows a dispense head in perspective,

FIG. 2 shows a beverage dispensing system having a dispense head mounted onto a beverage container, FIG. 3 an exploded view of a dispense head according to the invention, FIG. 4 shows a cross-sectional view of a dispense head in the first and deactivated position, FIG. 4A shows an enlarged view of a part of the dispense head shown in FIG. 4, FIG. 5A shows a cross-sectional view of a dispense head arranged on a flange of the beverage container, the dispense head is in its first position, FIG. 5B shows a cross-sectional view the dispense head of FIG. 5A where the outer shell is in its second position locking the stationary inner part to the flange, FIG. 5C shows a cross-sectional view of the dispense head of FIGS. 5A and 5B where the valve activation part has been moved downwards by activating the handle and thus activating the valve and compressing the sealing element, opening fluid communication with the gas channel, FIG. 6 shows an outer shell in perspective, FIG. 7 shows a stationary inner part in perspective, FIG. 8 shows the stationary inner part of FIG. 7 seen from one side, and FIG. 9 shows another locking unit.

All the figures are highly schematic and not necessarily to scale, and they show only those parts which are necessary in order to elucidate the invention, other parts being omitted or merely suggested.

FIG. 1 shows a dispense head 1 to be mounted on a beverage container 75 as shown in FIG. 2, the beverage container has an extractor tube with a valve (the extractor tube and valve are shown in FIG. 5A). In the present embodiment, the beverage container comprises a radially extending flange (also shown in FIG. 5A). When mounting the dispense head onto the beverage container, a beverage present in the beverage container is enabled to be dispensed via a dispensing line 39. The dispense head has an axial extension E as shown in FIG. 4.

As shown in FIG. 1, the dispense head comprises an outer shell 2 comprising a first aperture 3 configured to receive at least the dispensing line 39 and/or a gas inlet 4. In another embodiment, the dispensing line and the gas inlet may each have separate apertures. The outer shell is movable along the axial extension between a first position and a second position for fastening the dispense head onto the flange. The dispense head 1 further comprises a handle 15 pivoting around a pivot point for moving between a deactivated position as shown in FIG. 1 and an activated position (as shown in FIG. 5C) for moving a valve activation part downwards in order to activate the valve in the extractor tube.

The radially extending flange 38 may be arranged on the beverage container 75 or the radially extending flange may be arranged on the extractor tube. Normally, the well type extractor tubes have no flanges, hence the radially extending flange is then arranged on the beverage container. In connection with the flat type extractor tubes, the radially extending flange is arranged on the extractor tube. In the present embodiment, the radially extending flange is arranged on the beverage container.

In FIG. 3, an embodiment of the dispense head 1 according to the present invention is shown in an exploded view and comprises a stationary inner part 7 to be arranged inside the outer shell 2 and a first face 8 (shown in FIG. 4) of the stationary inner part configured to abut the flange. The stationary inner part 7 is axially stationary in relation to the flange. The stationary inner part 7 is also shown in FIG. 7 and has a first end 5 and a second end 6, where the second end 6 faces the beverage container. The stationary inner part 7 has a wall part 11 at the second end 6. The dispense head 1 further comprises a valve activation part 14 at least partly extending inside the stationary inner part and movable in relation the stationary inner part for activation of the valve. The handle 15 pivots around a pivot point 16 in the first end 5 of the stationary inner part 7 for moving between a deactivated position and an activated position for moving the valve activation part 14 in order to activate the valve. The dispense head 1 also comprises a locking unit 10 arranged at the second end 6 of the stationary inner part 7. The locking unit 10 is configured to be radially displaced inwards during the movement of the outer shell 2 from the first position to the second position thereby enabling locking of the flange along the axial extension. By locking the flange is meant that the locking unit is overlapping the flange seen in the radial extension. The dispense head 1 further comprises a fixation unit 12 configured to fixate the outer shell 2 in relation to the stationary inner part 7 in the second position of the outer shell 2.

By having at least one locking unit 10 moving radially inwards, the dispense head 1 is able to fit a larger variation of extractor tubes than known dispense heads. Known dispense heads are made so that each type of extractor tube matches only one type of dispense head. In addition, since the dispense head 1 according to the present invention is configured to lock the dispense head 1 to the flange, a uniform approach for coupling a dispense head to a beverage container is provided, irrespective of whether the extractor tube of the beverage container is a flat type or a well type extractor tube. In the present embodiment, a well type extractor tube is shown with the flange arranged on the beverage container. However, as mentioned before, the flange may also be arranged on the extractor tube.

The fixation unit 12 as shown in FIG. 3 comprises a groove 18 and a pin 19 engaging the groove. In the present embodiment the groove 18 is arranged in the stationary inner part 7, and the pin 19 is connected to a top part 24 of the outer shell 2. The pin 19 engages the groove 18 when the dispense head 1 is in its assembled condition as shown in FIG. 4.

The groove 18 has a first top point 21 and a second top point 22 being axially displaced along the axial extension, so that the first top point 21 is arranged closer to the handle 15 than the second top point 22. The pin 19 is in the first top point 21 when the outer shell 2 is in the first position and the pin 19 is in the second top point 22 when the outer shell 2 is in the second position. In FIGS. 3 and 7-8, the groove 18 is an endless groove, but in another embodiment, the groove could be a J-slot, a V-slot, or a similar groove having a first top point being axially displaced along the axial extension from a second top point of the groove.

In order to move the pin 19 from the first top point 21 to the second top point 22, the outer shell 2 is moved in relation to the stationary inner part 7 as shown in FIGS. 5A to 5B. In order to move the pin 19 from the second top point 22 to the first top point 21 again, the dispense head 1 comprises springs 23 being arranged between the top part 24 of the outer shell 2 and the stationary inner part 7, so that the springs 23 are compressed when moving the outer shell 2 from the first position to the second position and thus providing a spring force in order to move back to the first position if the user presses the outer shell a bit further downwards forcing the pin 19 to move further along the groove 18 and upwards the first top point 21 again allowing the outer shell 2 to move upwards in relation to the stationary inner part 7. The fixation unit of FIG. 3 functions more or less like a click pen.

As shown in FIG. 3, the stationary inner part 7 has four supports 56 for engaging the four springs 23.

The outer shell 2 may be assembled from two parts, i.e. a top part 24 and a lower part 25. The top part 24 and the lower part 25 are connected by a fastening element 26, shown in FIG. 3, engaging a shell aperture 54, shown in FIG. 6, so that the top part 24 and the lower part 25 move together when moving the outer shell 2 between the first position and the second position.

As can be seen in FIG. 4, the locking unit 10 is arranged at a distance d from the first face 8 and is configured to be radially displaced inwards during the movement of the outer shell 2 from the first position to the second position thereby enabling locking of the flange along the axial extension. The dispense head 1 is shown in the first position in FIG. 4.

In FIG. 4, the wall part 11 of the stationary inner part 7 has a through-bore 27 in which the locking unit 10 is displaced along a radial extension perpendicular to the axial extension E. The locking unit 10 has a thickness t1 in the radial extension being larger than a thickness t2 of the wall part. By having the thickness difference between t1 and t2, the locking unit 10 can easily be moved radially inwards when moving the outer shell 2 downwards. The wall part 11 of the stationary inner part 7 defines a circular bore 28 having a circumference 29 and an inner diameter ID1. The dispense head 1 comprises several locking units 10 distributed evenly along the circumference. The dispense head 1 as shown in FIG. 4 has four locking units 10, but in another embodiment, the dispense head may comprise 3-6 locking units evenly distributed along the circumference in order to grip around many different types of flanges of extractor tubes or beverage containers. Some extractor tubes may be chamfered and by having several locking units, the dispense head according to the present invention is still able to fit and lock around these chamfered extractor tubes.

In FIG. 6, the outer shell 2 has an opening 31 which in the first position is arranged opposite a first indicator 32, which is shown in FIG. 7, on the stationary inner part 7 and in the second position, the opening 31 is arranged opposite a second indicator 33, which is shown in FIG. 7, for indicating the position of the outer shell 2.

In FIG. 4A, the outer shell 2 has a first shell part 34 having a first distance D1 to the wall part 11 when being arranged opposite the locking unit 10 in the first position. The outer shell 2 has furthermore a second shell part 35 having a second distance D2 to the wall part 11 when being arranged opposite the locking unit in the second position. The second distance is smaller than the first distance so that when the outer shell 2 is moved downwards towards the beverage container, the second shell part 35 presses the locking unit 10 inwards for locking around the flange 38, as shown in FIG. 5B. In FIG. 5C, the handle 15 has been moved between the deactivated position of FIG. 5B to the activated position of FIG. 5C, moving the valve activation part downwards pressing onto the valve and thus activating the valve.

In FIGS. 4 and 4A, the valve activation part 14 has a through-bore 41 provided by a first wall 42 for guiding beverage from the container to the dispense line. The valve activation part 14 furthermore has a gas channel 43 having an annular gas channel part 44, circumferenting part of the through-bore 41 and being provided by a channel wall 45. The valve activation part 14 further comprises an annular sealing element 50 having a first element end part 51, an intermediate part 52 and a second element end part 53. The first element end part 51 is connected to the channel wall 45, the intermediate part abuts an outer face 46 of the first wall 42, and the second element end part 53 extends towards the beverage container. The first element end part 51 has a wall thickness t3 being smaller than that of the second element end part, so as to be able to bulge when compressed along the axial extension, as shown in FIG. 5C, opening for gas communication to the beverage container. The first element end part 51 has an inner diameter ID2 which is larger than that of the intermediate part ID3 so that the intermediate part abuts and seals against the outer face 46 of the first wall 42, preventing gas from entering the beverage container before the handle is moved to its activated position.

As can be seen in FIG. 4A, the first element end part 51 is connected to the channel wall 45 by means of a T-shaped part 55. The T-shaped part is not part of the first element end part when measuring the thickness of the first element end part compared to the thickness of the intermediate part or the second element end part. The thickness t4 of the second element end part 53 is furthermore thicker than both the first element end part and the intermediate part so that it does not bulge.

FIG. 9 shows an alternative locking unit 10 where the locking unit comprises at least one projection 62 configured to engage the flange of the extractor tube or the flange of the beverage container. The dispense head may comprise a plurality of first fingers 63 arranged around a circumference of the stationary inner part 7 with a mutual distance between them. Each finger has a first free end part 64, and the first free end part 64 comprises the projection 62. The locking unit 10 as shown in FIG. 9 may be displaced in the radial extension in the same manner as described above.

In another embodiment, the dispense head may comprise one or more projection(s) projecting radially from the stationary inner part, where the one or more projection(s) may be configured to engage one or more receiving guide(s) (not shown) arranged in the outer shell. The receiving guides are grooves or apertures having an extension in the axial extension so that the projection(s) is/are movable in the axial extension in the receiving guides when moving the outer shell between the first position and the second position.

The outer shell 2 is made of a polymeric material or metal, and the stationary inner part 7 and/or the valve activation part 14 is/are preferably made of a polymeric material. However, the stationary inner part 7 and/or the valve activation part 14 may also be made of metal or a composite.

In FIG. 2, a part of the beverage dispensing system 100 is shown. The beverage dispensing system 100 comprises a beverage container 75, on which the dispense head 1 is mounted. In addition, the dispensing line 39 is connected with the dispense head 1 and extends therefrom to a tapping head or tapping valve (not shown). The gas inlet 4 is in fluid communication with a gas supply (not shown) via a gas supply line 76.

As shown in FIG. 4, a pressure relief valve 60 is arranged in fluid communication with the gas inlet 4. The pressure relief valve 60 is configured to, in one position, pressure-equalise a gas present in the beverage container with the environment if the pressure exceeds a predetermined level.

Furthermore, a one-way valve 61 may be arranged in a gas channel, for avoiding any return liquid into the gas supply line.

As mentioned above, FIGS. 5A-5C disclose the activation of the dispense head 1 according to the present invention. In FIG. 5A, the dispense head 1 has been positioned on the flange 38, and the outer shell 2 is in the first position. The flange 38 is part of the beverage container 75. In FIG. 5B, the outer shell 2 has been moved into the second position by pressing the outer shell 2 downwards in relation to the stationary inner part 7 whereby the locking units 10 are moved radially towards and below the flange 38 thereby locking the stationary inner part 7 to the flange. In the second position of the outer shell 2, the fixation unit is configured to fixate the outer shell 2 in relation to the stationary inner part 7 so that the locking units 10 are maintained in their locking positions. Then, the dispense head 1 is securely locked to the extractor tube of the beverage container 75. When the dispense head 1 is securely connected with the flange, the dispense head 1 is ready to activate the valve of the extractor tube.

In FIG. 5C, the handle 15 has been moved from the deactivated position to the activated position whereby the valve activation part 14 has been moved down towards the valve of the extractor tube for opening the valve. During the same downward movement of the valve activation part 14, the annular sealing element 50 abuts the valve and due to its design and flexible material, the annular sealing element 50 will start to bulge upwards, thereby opening for the gas to the beverage container so that the gas will be used to propel the beverage out of the beverage container. Hence, the annular sealing element 50 functions as a gas valve of the dispense head. The valve of the extractor is normally defined as a double valve.

When the dispense head 1 is to be deactivated, the handle 15 is moved from the activated position to the deactivated position, whereby the valve activation part 14 is moved axially away from the valve in order to close the valve and close for the dispensing of beverage out of the beverage container. With the same upwards movement of the valve activation part 14, the annular sealing element 50 is returning to its relaxed position in which it seals the gas channel. Hereinafter, the fixation unit is deactivated for bringing the outer shell from the second position to the first position whereby the locking units are unlocked from the flange. The dispense head 1 may then be removed from the beverage container by pulling it upwards and away from the beverage container.

Although the invention has been described in the above in connection with preferred embodiments of the invention, it will be evident for a person skilled in the art that several modifications are conceivable without departing from the invention as defined by the following claims.

The invention claimed is:

1. A dispense head to be mounted on a beverage container having an extractor tube with a valve, the beverage container or the extractor tube having a radially extending flange, the dispense head enabling a beverage present in the beverage container to be dispensed via a dispensing line connected with the dispense head, the dispense head having an axial extension and comprising:

an outer shell comprising a first aperture configured to receive at least the dispensing line and/or a gas inlet, the outer shell being movable along the axial extension between a first position and a second position, a stationary inner part arranged inside the outer shell, a first face of the stationary inner part being configured to abut the flange and be axially stationary in relation to the flange, the stationary inner part having a first end and a second end facing the beverage container, the stationary inner part having a wall part at the second end, a valve activation part at least partly extending inside the stationary inner part and movable in the axial extension in relation the stationary inner part for activation of the valve, and a handle pivoting around a pivot point in the first end of the stationary inner part for moving between a deactivated position and an activated position for moving the valve activation part in order to activate the valve, wherein the dispense head further comprises:

a locking unit arranged at the second end of the stationary inner part, the locking unit being arranged at a distance from the first face and configured to be radially displaced during the movement of the outer shell from the first position to the second position thereby enabling locking of the flange along the axial extension, and a fixation unit configured to fixate the outer shell in relation to the stationary inner part at least in the second position of the outer shell.

2. A dispense head according to claim 1, wherein the fixation unit comprises a groove and a pin engaging the groove, the groove being arranged in the stationary inner part or the outer shell and the pin being connected to the other of the stationary inner part and the outer shell.

3. A dispense head according to claim 2, wherein the groove has a first top point and a second top point being axially displaced along the axial extension so that the first top point is arranged closer to the handle than the second top point.

4. A dispense head according to claim 3, wherein the pin is in the first top point when the outer shell is in the first position and the pin is in the second top point when the outer shell is in the second position.

5. A dispense head according to claim 1, wherein one or more springs is/are arranged between a top part of the outer shell and the stationary inner part so that the one or more springs is/are being compressed when moving the outer shell from the first position to the second position.

6. A dispense head according to claim 1, wherein the wall part of the stationary inner part has a through-bore in which the locking unit is displaced along a radial extension perpendicular to the axial extension, the locking unit having a thickness in the radial extension being larger than a thickness of the wall part.

7. A dispense head according to claim 1, wherein the wall part of the stationary inner part defines a circular bore having a circumference and an inner diameter.

8. A dispense head according to claim 7, wherein the dispense head comprises several locking units distributed along the circumference.

9. A dispense head according to claim 1, wherein the outer shell has an opening which in the first position is arranged opposite a first indicator on the stationary inner part and in the second position is arranged opposite a second indicator for indicating the position of the outer shell.

10. A dispense head according to claim 1, wherein the outer shell has a first shell part having a first distance to the wall part when being arranged opposite the locking unit in the first position, and wherein the outer shell has a second shell part having a second distance to the wall part when being arranged opposite the locking unit in the second position, the second distance being smaller than the first distance.

11. A dispense head according to claim 1, wherein the valve activation part has an axially extending through-bore provided by a first wall for guiding beverage from the beverage container to the dispensing line, and wherein the valve activation part furthermore has a gas channel having an annular gas channel part circumferenting the through-bore and being provided by a channel wall.

12. A dispense head according to claim 11, wherein the valve activation part further comprises an annular sealing element, the annular sealing element having a first element end part, an intermediate part and a second element end part, the first element end part being connected to the channel wall, the intermediate part abutting an outer face of the first wall, and the second element end part extending towards the beverage container, the first element end part has a wall thickness smaller than that of the second element end part so as to be able to bulge when compressed along the axial extension.

13. A dispense head according to claim 12, wherein the first element end part has an inner diameter being larger than that of the intermediate part.

14. A beverage dispensing system comprising a beverage container having an extractor tube with a valve), the beverage container or the extractor tube having a radially extending flange, a dispense head according to claim 1 is coupled to the beverage container, a dispensing line, and a gas supply in fluid communication with a gas inlet of the dispense head.

15. A dispense head activation method, comprising providing a dispense head according to claim 1, positioning the dispense head opposite the valve of the extractor tube of the beverage container so that the locking unit is arranged below the flange, moving the outer shell from the first position to the second position so that the locking unit is locking the flange while the fixation unit fixates the outer shell and the stationary inner part to each other, and activating the handle for moving it from a deactivated position to an activated position, whereby the valve activation part is moved axially in order to activate the valve and open for dispensing of beverage out of the beverage container.

16. A dispense head deactivation method according to claim 15, comprising activating the handle by moving it from the activated position to the deactivated position whereby the valve activation part is moved axially away from the valve in order to close the valve and close for the dispensing of beverage from the beverage container and at the same time close a supply of gas, deactivating the fixation unit of the dispense head bringing the outer shell from the second position to the first position, and removing the dispense head from the beverage container.

* * * * *